US011535990B2

(12) United States Patent
Yu et al.

(10) Patent No.: US 11,535,990 B2
(45) Date of Patent: Dec. 27, 2022

(54) TWO-STAGE ENERGY DISSIPATION TYPE SHED TUNNEL SUPPORT STRUCTURE CONNECTED BY PRINCIPLE OF DOUGONG AND A DESIGN METHOD THEREOF

(71) Applicant: Southwest Jiaotong University, Chengdu (CN)

(72) Inventors: Zhixiang Yu, Chengdu (CN); Liru Luo, Chengdu (CN); Linxu Liao, Chengdu (CN); Yuntao Jin, Chengdu (CN); Lijun Zhang, Chengdu (CN); Hu Xu, Chengdu (CN); Lei Zhao, Chengdu (CN); Hao Zhao, Chengdu (CN); Shichun Zhao, Chengdu (CN)

(73) Assignees: Southwest Jiaotong University, Chengdu (CN); Southwest Jiaotong University Chengdu Design Institute Co., Ltd., Chengdu (CN)

( * ) Notice: Subject to any disclaimer, the term of this patent is extended or adjusted under 35 U.S.C. 154(b) by 95 days.

(21) Appl. No.: 17/200,932

(22) Filed: Mar. 15, 2021

(65) Prior Publication Data

US 2022/0127804 A1 Apr. 28, 2022

(30) Foreign Application Priority Data

Oct. 27, 2020 (CN) ..... 202011159965.7

(51) Int. Cl.
*E01F 7/04* (2006.01)

(52) U.S. Cl.
CPC ..... *E01F 7/045* (2013.01)

(58) Field of Classification Search
CPC ..... E01F 7/00; E01F 7/02; E01F 7/025; E01F 7/04; E01F 7/045; E04B 2001/3235;
(Continued)

(56) References Cited

U.S. PATENT DOCUMENTS 76,418 A * 4/1868 Donisthorne ..... E21D 15/44 405/290
1,528,034 A * 3/1925 Thielmann ..... E21D 15/52 405/288

(Continued)

FOREIGN PATENT DOCUMENTS

DE 1132524 B * 7/1962 ..... E21D 19/04

OTHER PUBLICATIONS

GB50017-2017, Ministry of Housing and Urban-Rural Development of the People's Republic of China, Standard for design of steel structures, 2017, China Construction Industry Press.

(Continued)

*Primary Examiner* — Josh Skroupa
(74) *Attorney, Agent, or Firm* — Bayramoglu Law Offices LLC

(57) ABSTRACT

A two-stage energy dissipation type shed tunnel support structure connected by a principle of Dougong and a design method thereof are provided. The two-stage energy dissipation type shed tunnel support structure includes a Dougong joint domain, crossbeams and columns. The Dougong joint domain includes section steel members, wavy-wall cylindrical elastoplastic buffers, U-shaped sliding connecting troughs and high-strength bolts. Multiple layers of the section steel members are orthogonally stacked to form a Dougong shape, the wavy-wall cylindrical elastoplastic buffers are arranged between adjacent layers of the section steel members, and the U-shaped sliding connecting troughs are arranged at upper and lower ends of the wavy-wall cylindrical elastoplastic buffers, which realizes a connection between the wavy-wall cylindrical elastoplastic buffers and a section steel in two orthogonal directions. Under an impact of small energy rockfalls, an elastic deformation of the Dougong joint domain is used to achieve a buffering.

20 Claims, 5 Drawing Sheets

(58) Field of Classification Search
CPC ..... E04B 2001/324; E04B 2001/3252; E21D 19/04; E21D 23/0086
USPC ..... 256/1, 13.1; 405/288, 290, 302.1
See application file for complete search history.

(56) References Cited

U.S. PATENT DOCUMENTS 1,781,063 A * 11/1930 Jessen ..... E21D 15/54 405/290
3,812,680 A * 5/1974 Walbrohl ..... E21D 23/0086 405/290
4,629,369 A * 12/1986 Cox ..... B66C 19/00 405/288
4,676,697 A * 6/1987 Stafford ..... E21D 19/04 405/288
4,710,064 A * 12/1987 Stafford ..... E21D 19/04 405/288
5,746,547 A * 5/1998 Reinmann ..... E21D 15/04 405/288
9,822,530 B2 * 11/2017 Reisdorff ..... E04G 17/16
11,248,464 B2 * 2/2022 Xin ..... E21D 19/04

OTHER PUBLICATIONS

GB 50010-2010, Ministry of Housing and Urban-Rural Development of the People's Republic of China, Code for design of concrete structures, 2010, China Construction Industry Press.

* cited by examiner

TWO-STAGE ENERGY DISSIPATION TYPE SHED TUNNEL SUPPORT STRUCTURE CONNECTED BY PRINCIPLE OF DOUGONG AND A DESIGN METHOD THEREOF

CROSS REFERENCE TO THE RELATED APPLICATIONS

This application is based upon and claims priority to Chinese Patent Application No. 202011159965.7, filed on Oct. 27, 2020, the entire contents of which are incorporated herein by reference.

TECHNICAL FIELD

This application relates to the field of geological disaster protection for slopes, specifically to a two-stage energy dissipation type shed tunnel support structure connected by principle of Dougong, which is suitable for joint connection of key force transmission parts of a collapsed rockfall disaster protection structure, and a design method thereof.

BACKGROUND

China is a mountainous country, and rockfall disasters often have a destructive impact on transportation and urban infrastructure, and are related to people's livelihood and safety. Therefore, the arterial traffic such as roads and railways has an urgent need for the protection of collapsed rockfall disasters.

At present, reinforced concrete shed tunnels or flexible protective shed tunnels are commonly used for rockfall impact protection, and the basic type is "support structure+buffer layer". Beam-column joint of a traditional shed tunnel support structure are usually connected by bolts and welding, and the support structure often only plays a supporting role and does not have energy dissipation buffering capacity. Therefore, when the structure is impacted by rockfall, once the buffer layer fails, the support structure, especially the beam-column joints, is often accompanied by failure and damage due to the impact, and is difficult to quickly repair, which has a serious impact on the emergency rescue of urban traffic.

SUMMARY

In view of the above problems, the purpose of the present application is to provide a novel shed tunnel support structure with energy dissipation buffering capacity. By referring to the principle of Chinese ancient architectural Dougong, the present application provides a two-stage energy dissipation type shed tunnel support structure connected by Dougong and a design method thereof.

In order to achieve the above purpose, the present application adopts the following technical solutions:

On one aspect, the present application protects a two-stage energy dissipation type shed tunnel support structure connected by the principle of Dougong, including:

Dougong joint domain, crossbeams and columns, wherein lower ends of the Dougong joint domain are supported on the columns, and upper ends support the crossbeams;

the Dougong joint domain includes section steel members, buffers, and U-shaped sliding connecting troughs;

the section steel members are arranged in layers, the upper and lower layers of section steel members are connected by the buffers, and the multiple layers of section steel members are orthogonally stacked to form a "gong (Chinese character, which means an arch)";

the "Dou (Chinese character, which means a bucket)"-shaped support structure includes the buffers and the U-shaped sliding connecting troughs arranged at two ends of the buffers, and the connecting troughs at the two ends of the buffers are respectively connected to the upper and lower layers of section steel members.

Further, the crossbeam is supported on the top section steel members of the Dougong joint domain, one side of an angle steel is fixed to the top section steel member, and the other side is fixed to the crossbeam.

Further, steel plates are fixed at bottoms of the buffers below the bottom section steel members of the Dougong joint domain, and high-strength bolts B penetrate through the steel plates to fix the steel plates to the columns.

Further, the U-shaped sliding connecting trough is provided with slotted holes, and high-strength bolts A penetrate through the slotted holes and are fixed in corresponding reserved holes on the side wall of the corresponding section steel member.

Further, the corresponding positions of connection surfaces of the angle steel and the crossbeam are preset with slotted holes, high-strength bolts B penetrate through the angle steel and the crossbeam to pre-tighten the two, and when the structure is impacted, the crossbeam can controllably slide along the slotted holes to form a friction energy dissipation surface.

Further, a flange is provided between the crossbeams and the top section steel members to ensure that the crossbeam accurately transmits the upper load to an expected position of the Dougong joint domain.

Further, the buffers are wavy-wall cylindrical elastoplastic buffers, which are formed by pressing thin-walled short tubes of an elastoplastic material with wavy walls.

Further, each layer has not less than two section steel members.

Further, the side wall of the U-shaped sliding connecting trough is closely attached to the side wall of the section steel member, and is pre-polished by shot blasting to form a friction energy dissipation surface.

On another aspect, the present application further protects a design method of the two-stage energy dissipation type shed tunnel support structure connected by the principle of Dougong, including the following steps:

a. presetting the protection capability $E_{impact}$ of a shed tunnel;

b. calculate the impact energy $E_{structure}$ received by the support structure, wherein the calculation formula is $$E_{structure} = \alpha\varphi E_{impact}$$

where, $\alpha$ is an energy dissipation distribution coefficient of the support structure, which is an empirical value, and can be 0.2-0.4; $\varphi$ is a safety factor, which is an empirical value, and should be not less than 2;

c. estimating the energy dissipation $E_{Dougong}$ of a single Dougong joint domain (1), wherein the calculation formula is $$E_{Dougong} = \beta E_{structure}$$

where, β is an energy dissipation coefficient of a single Dougong joint domain;

d, designing the number n of joint layers according to construction requirements;

e. designing the energy dissipation buffering capacity $E_S$ of a single wavy-wall cylindrical elastoplastic buffer according to the energy dissipation $E_{Dougong}$ of the single Dougong joint domain (1) and the number n of joint layers, satisfying:

$$4nE_S \geq E_{Dougong}$$

f. selecting wavy-wall cylindrical elastoplastic buffers (12) of corresponding specifications according to the required energy dissipation capacity $E_S$, wherein the specification parameters are: material type, wall thickness, cylindrical diameter and height, and wave number:

g. selecting section steel members (11) of corresponding specifications according to the flexural bearing capacity, wherein the principle of design is, under rated energy dissipation requirements, only the plastic deformation of the cross section is considered, and the following should be satisfied:

$$\frac{M}{\gamma W} \geq f$$

where, M is a maximum bending moment that a member bears, the member almost only bears uniaxial bending moment, and the value of bending moment can be obtained by numerical calculation; W is a net section modulus of an axis corresponding to the bending moment; γ is a section plastic development coefficient, which is not more than 1.1; f is a design value of bending strength of steel;

h. obtaining the required bearing capacities of crossbeams (2) and columns (3) by numerical calculations, and designing the crossbeams and columns of the support structure; and i. checking, by numerical calculations or experiments, whether the protection requirements are met.

Compared with the prior art, the present application has the following beneficial effects:

1. The present application introduces Dougong joint domain with buffering capacity into a protective shed tunnel support structure, which adds two energy dissipation paths: buffers and friction energy dissipation surfaces, thereby improving the overall energy dissipation capacity of a protective shed tunnel. The Dougong joint domain are reduced from top to bottom, and the upper overhang enlarges the force bearing area. Under the impact of small energy rockfalls, the elastic deformation and friction energy dissipation of the Dougong joint domain can be used to achieve buffering; under the impact of large energy rockfalls, the elastoplastic deformation and friction energy dissipation of the Dougong joint domain can be used to achieve energy dissipation; therefore, the support structure has two-stage energy dissipation buffering capacity, and can meet the protection requirements for large energy impact.

2. The present application improves the beam-column joints of the protective shed tunnel support structure, the beams and columns are connected by the Dougong joint domain which are prone to elastoplastic deformation, the Dougong joints are prefabricated and easy to process and replace, and once the shed tunnel is impacted, the joints can complete energy dissipation buffering and be quickly replaced, so that the protective shed tunnel quickly restores to the normal working status to ensure the smoothness of traffic lifelines; meanwhile, the Dougong joint domain with buffering performance protect the ends of the beams and columns, which prolongs the service life of the structure and has significant economic advantages.

3. The energy dissipation type protective shed tunnel support structure according to the present application can be flexibly used for reinforced concrete shed tunnels and flexible protective steel shed tunnels, with various forms. The support structure can be designed according to protection requirements and structural requirements, with strong structural suitability.

BRIEF DESCRIPTION OF THE DRAWINGS

In order to describe the technical solutions in the embodiments of the present application or in the prior art more clearly, the following briefly introduces the accompanying drawings required for describing the embodiments or the prior art. Apparently, the accompanying drawings in the following description show some embodiments of the present application, and a person of ordinary skill in the art may still derive other drawings from these accompanying drawings without creative efforts.

In the figures, the same reference signs are used to denote the same structures or parts, and the names of the structures or parts corresponding to the reference signs are as follows:

1—Dougong joint domain; 11—section steel member; 12—wavy-wall cylindrical elastoplastic buffer; 13—U-shaped sliding connecting trough; 14—high-strength bolt A; 2—crossbeam; 3—column; 4—angle steel; 5—rectangular steel plate; 6—high-strength bolt B; 7—corbel; 8—flange; 9—buffer layer; 10—concrete slab.

DETAILED DESCRIPTION OF THE EMBODIMENTS

In order to make the objectives, technical solutions and advantages of the present application clearer, the technical solutions in the embodiments of the present invention will be clearly and completely described below with reference to the accompanying drawings in the embodiments of the present application. Apparently, the described embodiments are only part of the embodiments of the present application, not all of them. All other embodiments obtained by those of ordinary skill in the art without creative efforts based on the embodiments of the present application shall fall within the protection scope of the present application.

In the present application, energy dissipation buffering beam-column connection joints are formed based on the principle of Chinese ancient architectural Dougong, to achieve the effects of elastoplastic deformation buffering, friction energy dissipation, outrigger supporting and the like similar to those of plate springs. Under the impact of small energy rockfalls, the elastic deformation of Dougong joint domain can be used to achieve buffering; under the impact of large energy rockfalls, the elastoplastic deformation of the Dougong joint domain and the friction between members can be used to achieve energy dissipation; therefore, two-stage energy dissipation buffering capacity is achieved, and a novel rockfall protection shed tunnel support structure is formed. The Dougong joint domain of the support structure can be completely prefabricated, serialized and conventionalized, is easy to assemble and can be replaced independently, which facilitates the assembly and maintenance of the shed tunnel structure.

Figure 2:
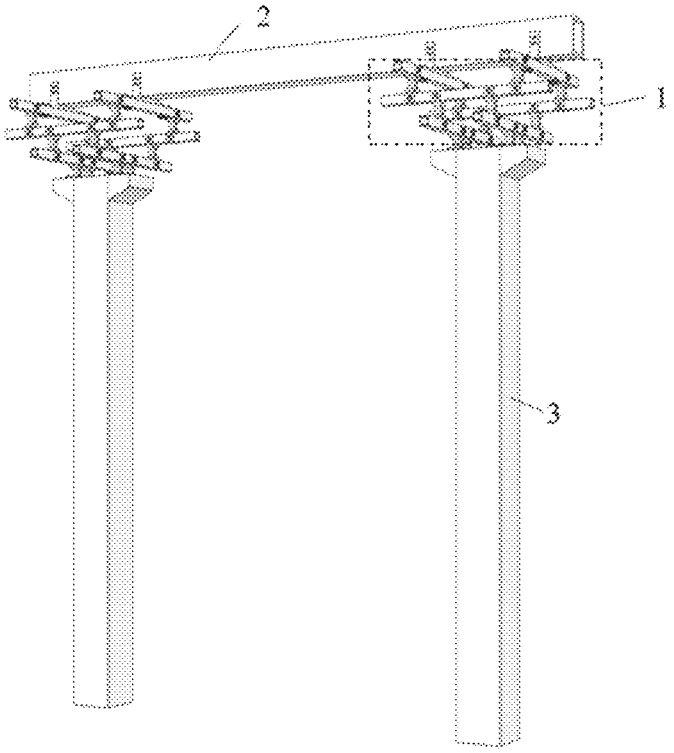
FIG. 2 is an overall structure diagram of the two-stage energy dissipation type shed tunnel support structure connected by Dougong joint domain according to the present application.

As shown in FIG. 2, a two-stage energy dissipation type shed tunnel support structure connected by Dougong joint domain according to an embodiment of the present application includes Dougong joint domain 1, crossbeams 2 and columns 3.

Figure 3:
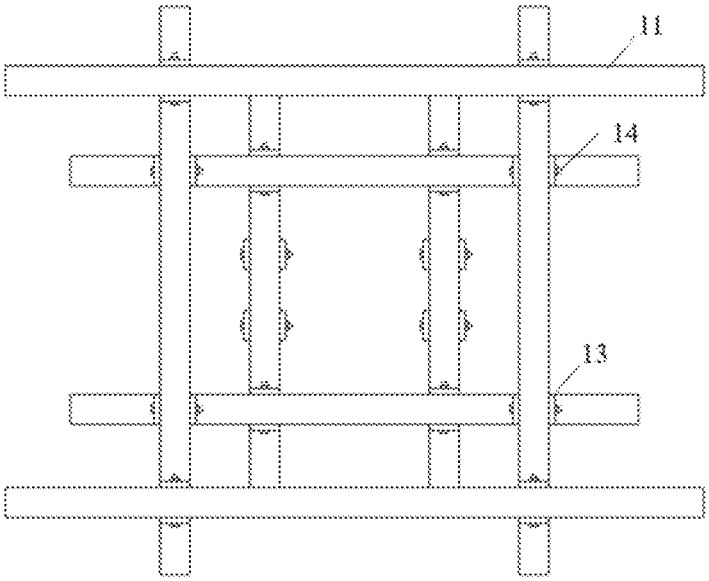
FIG. 3 is a top view of a Dougong joint domain of the two-stage energy dissipation type shed tunnel support structure connected by Dougong joint domain according to the present application.
Figure 4:
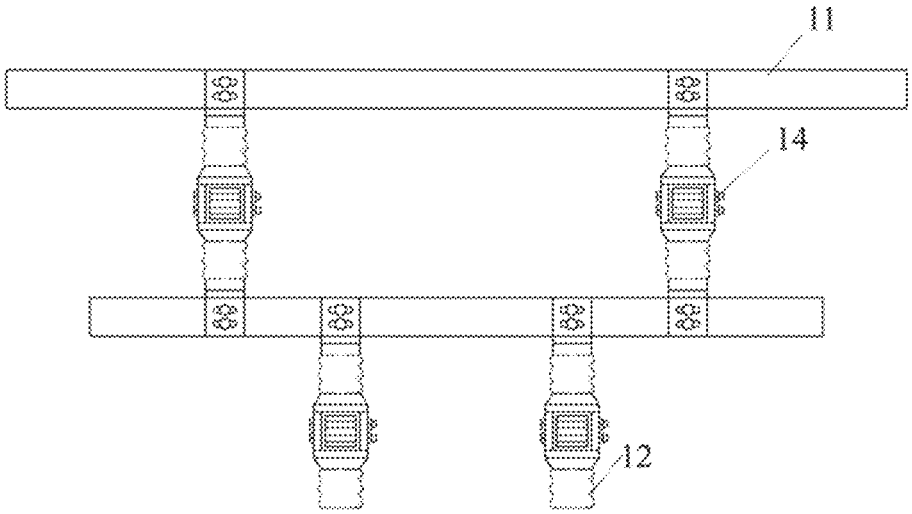
FIG. 4 is a side view of the Dougong joint domain of the two-stage energy dissipation type shed tunnel support structure connected by Dougong joint domain according to the present application.

In the embodiment of the present application, as shown in FIGS. 3 and 4, the Dougong joint domain 1 is composed of section steel members 11, wavy-wall cylindrical elastoplastic buffers 12, U-shaped sliding connecting troughs 13 and high-strength bolts A 14.

Each layer has not less than two section steel members 11, which are orthogonally overlapped in vertical and horizontal directions and stacked in multiple layers to form a "gong". There is a certain height difference between the stacked adjacent layers of section steel members 11 for arranging the buffers.

Figure 5:
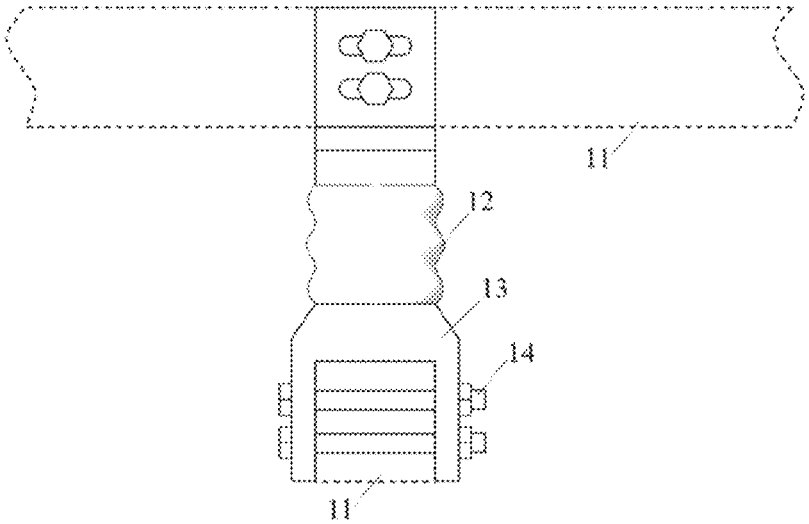
FIG. 5 is a schematic diagram of a wavy-wall cylindrical elastoplastic buffer of the two-stage energy dissipation type shed tunnel support structure connected by Dougong joint domain according to the present application.

As shown in FIG. 5, the wavy-wall cylindrical elastoplastic buffer 12 is a thin-walled short tube of an elastoplastic material, which is pressed with a wavy wall. The U-shaped sliding connecting troughs 13 are welded to the upper and lower ends of the wavy-wall cylindrical elastoplastic buffers 12, and openings of the two U-shaped troughs are orthogonal to connect the buffers with the upper and lower layers of orthogonal steel members 11.

The wavy-wall cylindrical elastoplastic buffers 12 and the U-shaped sliding connecting troughs 13 constitute a "Dou". The U-shaped sliding connecting trough 13 is provided with slotted holes that are aligned with preset slotted holes at corresponding positions of a section steel side wall, and the high-strength bolts A 14 penetrate the slotted holes of the two for pre-tightening. The side wall of the U-shaped sliding connecting trough 13 is closely attached to the section steel side wall, and is pre-polished by shot blasting to form a friction energy dissipation surface.

Figure 6:
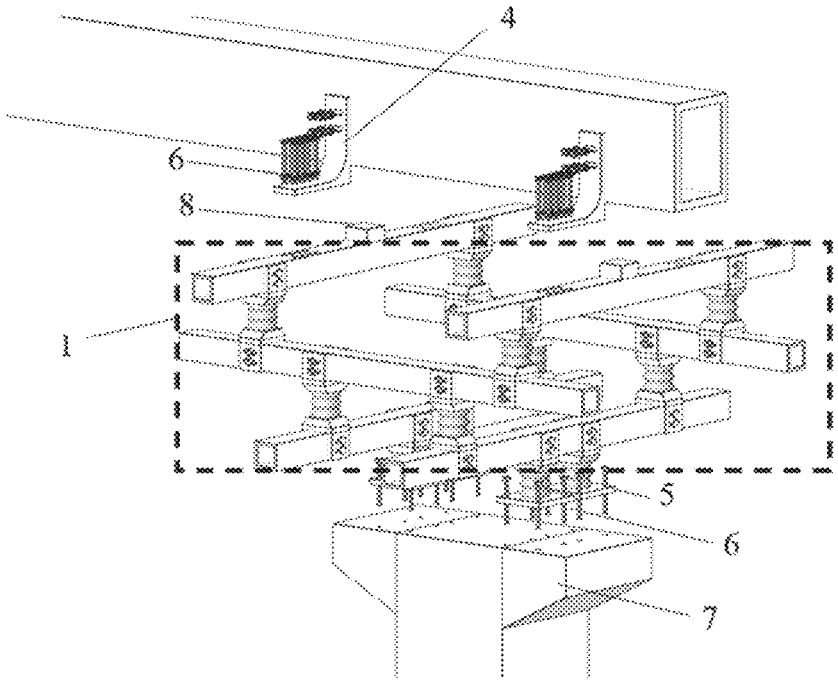
FIG. 6 is a schematic installation diagram of the two-stage energy dissipation type shed tunnel support structure connected by Dougong joint domain according to the present application.

As shown in FIG. 6, the Dougong joint domain 1 are connected with the crossbeam 2 of the support structure by angle steel 4 and high-strength bolts B 6 above the top section steel members of the Dougong joint domain 1.

The corresponding positions of connection surfaces of the angle steel 4 and the side wall of the crossbeam 2 are preset with slotted holes, aligned and pre-tightened by high-strength bolts B 6, so that when the structure is impacted, the crossbeam 2 can controllably slide along the slotted holes to form a friction energy dissipation surface.

A flange 8 is provided between the crossbeam 2 and the top section steel member 11 of a joint to ensure that the crossbeam accurately transmits the upper load to an expected position of the Dougong joint domain 1.

A layer of wavy-wall cylindrical elastoplastic buffers 12 is arranged below the bottom section steel members 11 of the Dougong joint domain 1, the wavy-wall cylindrical elastoplastic buffers 12 are still connected with the section steel members 11 by the U-shaped sliding connecting troughs 13, rectangular steel plates 5 are welded below the buffers, the steel plates 5 are punched, and the Dougong joint domain 1 are connected with the columns 3 of the support structure by high-strength bolts B 6.

Figure 7:
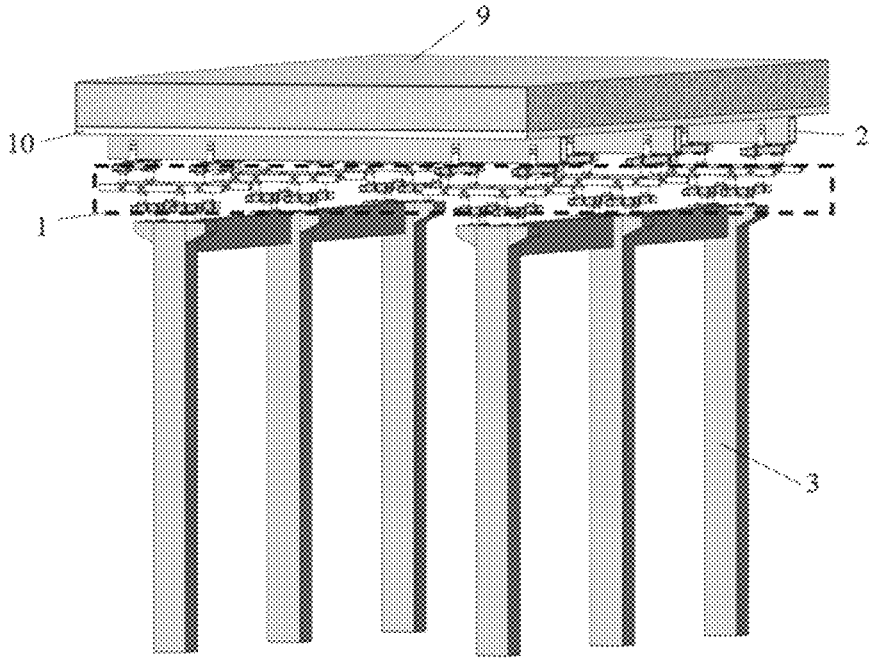
FIG. 7 shows a first embodiment of combined use of two-stage energy dissipation type shed tunnel support structures connected by Dougong joint domain according to the present application.
Figure 8:
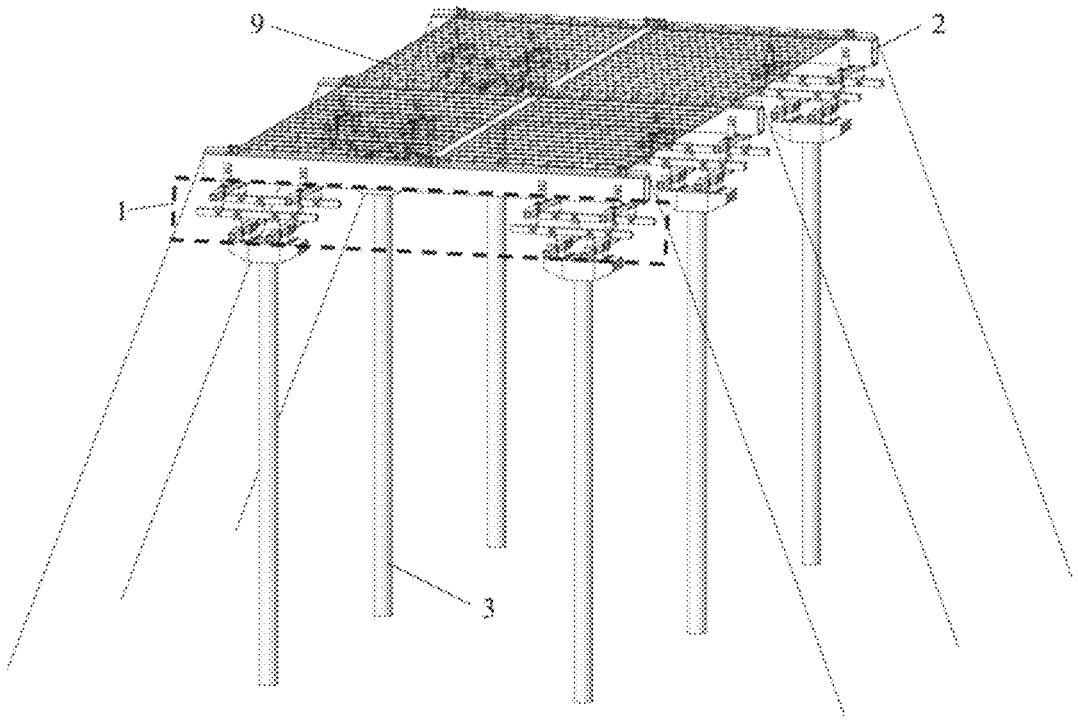
FIG. 8 shows a second embodiment of combined use of two-stage energy dissipation type shed tunnel support structures connected by Dougong joint domain according to the present application.

As shown in FIGS. 7 and 8, in the two-stage energy dissipation type shed tunnel support structure connected by Dougong joint domain, a flexible buffer layer can also be laid on the crossbeam 2 to form a flexible protective steel shed tunnel.

The protective shed tunnel of the two-stage energy dissipation type shed tunnel support structure connected by Dougong joint domain increases the energy dissipation path and improves the overall energy dissipation capacity of the rockfall protective shed tunnel. Under the impact of small energy rockfalls, the elastic deformation of the Dougong joint domain can be used to achieve buffering; under the impact of large energy rockfalls, the elastoplastic deformation of the Dougong joint domain can be used to achieve energy dissipation; therefore, the support structure has two-stage energy dissipation buffering capacity, and can meet the protection requirements for large energy impact. The crossbeams and columns are connected by the Dougong joint domain which are prone to elastoplastic deformation, the Dougong joints are prefabricated and easy to process and replace, and once the shed tunnel is impacted, the joints can complete energy dissipation buffering and be quickly replaced, so that the protective shed tunnel quickly restores to the normal working status to ensure the smoothness of traffic lifelines; meanwhile, the Dougong joint domain with buffering performance protect the ends of the crossbeams and columns, which prolongs the service life of the structure and has significant economic advantages.

Embodiment of Design Method

Figure 1:
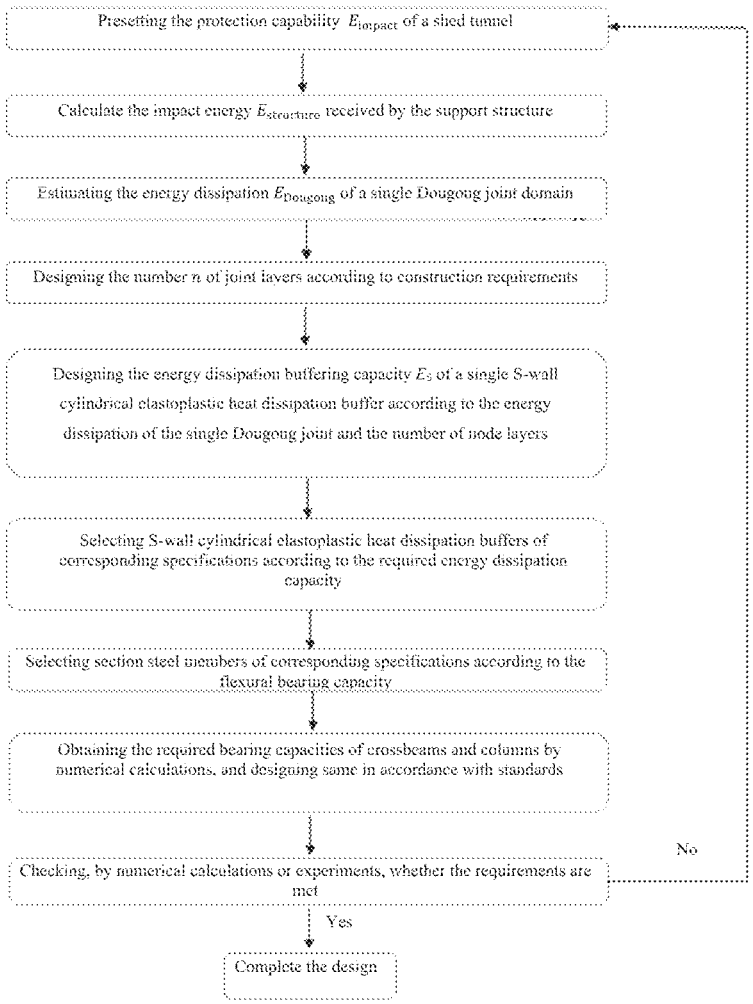
FIG. 1 is a flowchart of a design method of a two-stage energy dissipation type shed tunnel support structure connected by Dougong joint domain according to the present application.

The following specifically describes, in combination with a rockfall disaster site, a design method of the two-stage energy dissipation type shed tunnel support structure connected by Dougong joint domain:

As shown in FIG. 1, according to the geological survey data, the protection goal on this site is to intercept a rockfall with impact energy $E_{impact}$=1000 kJ, a reinforced concrete shed tunnel is supposed for protection, and a buffering energy dissipation type cushion with energy dissipation efficiency of 0.6 is laid on the shed tunnel. Here, regardless of the impact energy dissipated by interaction of multi-span structures, it is presupposed that the impact energy can be exhausted by a one-span (two-sided) support structure;

The impact energy received by the two-sided support structure is $E_{structure}=\alpha\varphi E_{impact}$, where $\alpha$ is an energy dissipation distribution coefficient of the support structure, and is 0.4 here; $\varphi$ is a safety factor, and is 2, then $E_{structure}=0.4*2*1000=800$ kJ;

A single Dougong joint domain dissipates energy $E_{Dougong}=\beta E_{structure}$, and the two-sided support structure has a total of four buffering joints, so the value of $\beta$ is 0.25, $E_{Dougong}=200$ kJ;

The preset number of layers of the Dougong joints is n=4;

The energy dissipation buffering capacity of a single wavy-wall cylindrical elastoplastic buffer is $E_S \geq E_{Dougong}/4n$, namely $E_S \geq 12.5$ kJ;

The wavy-wall cylindrical elastoplastic buffers of corresponding specifications are selected according to the required energy dissipation capacity, wherein the specification parameters are: material type, wall thickness, cylindrical diameter and height, and wave number. Details are not described herein again;

Section steel members of corresponding specifications are designed according to the flexural bearing capacity, wherein the principle of design is, under rated energy dissipation requirements, only the plastic deformation of the cross section is considered, and the following should be satisfied:

$$\frac{M}{\gamma W} \geq f$$

Where, M is a maximum bending moment that a member bears, the member almost only bears uniaxial bending moment, and the value of bending moment can be obtained by numerical calculation; W is a net section modulus of an axis corresponding to the bending moment; $\gamma$ is a section plastic development coefficient, which is not more than 1.1; f is a design value of bending strength of steel;

The required bearing capacities of crossbeams and columns are obtained by numerical calculations, and the crossbeams and columns of the support structure are designed in accordance with Steel Structure Design Standard GB50017-2017 and Concrete Structure Design Code GB 50010-2010;

Whether the protection requirements are met is checked by numerical calculations or experiments.

Finally, it should be noted that the above embodiments are merely intended to describe the technical solutions of the present application, instead of limiting the present application. Although the present application is described in detail with reference to the aforementioned embodiments, a person of ordinary skill in the art should understand that the technical solutions described in the aforementioned embodiments may still be modified, or some of the technical features therein may be equivalently substituted; and these modifications or substitutions do not cause the essence of the technical solutions to depart from the spirit and scope of the technical solutions of the embodiments of the present application.

What is claimed is:

1. A two-stage energy dissipation type shed tunnel support structure connected by a principle of Dougong, comprising:

a Dougong joint domain, a crossbeam and columns, wherein lower ends of the Dougong joint domain are supported on the columns, and upper ends of the Dougong joint domain support the crossbeam;

the Dougong joint domain comprises section steel members, buffers, and U-shaped sliding connecting troughs;

the section steel members are arranged in a plurality of layers, upper and lower layers of the section steel members are connected by the buffers, and the plurality of layers of the section steel members are orthogonally stacked to form a "gong";

a "Dou"-shaped support structure comprises the buffers and the U-shaped sliding connecting troughs arranged at two ends of the buffers, and the U-shaped sliding connecting troughs at the two ends of the buffers are respectively connected to the upper and lower layers of the section steel members.

2. The two-stage energy dissipation type shed tunnel support structure according to claim 1, wherein the crossbeam is supported on top section steel members of the Dougong joint domain, a first side of an angle steel is fixed to the top section steel members, and a second side of the angle steel is fixed to the crossbeam.

3. The two-stage energy dissipation type shed tunnel support structure according to claim 2, wherein corresponding positions of connection surfaces of the angle steel and the crossbeam are preset with slotted holes, bolts penetrate through the angle steel and the crossbeam to pre-tighten the angle steel and the crossbeam, and when the two-stage energy dissipation type shed tunnel support structure is impacted, the crossbeam controllably slides along the slotted holes to form a friction energy dissipation surface.

4. The two-stage energy dissipation type shed tunnel support structure according to claim 3, wherein the buffers are wavy-wall cylindrical elastoplastic buffers, wherein the wavy-wall cylindrical elastoplastic buffers are formed by pressing thin-walled short tubes of an elastoplastic material with wavy walls.

5. The two-stage energy dissipation type shed tunnel support structure according to claim 2, wherein a flange is provided between the crossbeam and the top section steel members to ensure that the crossbeam accurately transmits an upper load to an expected position of the Dougong joint domain.

6. The two-stage energy dissipation type shed tunnel support structure according to claim 5, wherein the buffers are wavy-wall cylindrical elastoplastic buffers, wherein the wavy-wall cylindrical elastoplastic buffers are formed by pressing thin-walled short tubes of an elastoplastic material with wavy walls.

7. The two-stage energy dissipation type shed tunnel support structure according to claim 2, wherein steel plates are fixed at bottoms of the buffers below bottom section steel members of the Dougong joint domain, and bolts penetrate through the steel plates to fix the steel plates to the columns.

8. The two-stage energy dissipation type shed tunnel support structure according to claim 2, wherein each of the U-shaped sliding connecting troughs is provided with slotted holes, and bolts penetrate through the slotted holes and the bolts are fixed in corresponding reserved holes on a side wall of a corresponding section steel member.

9. The two-stage energy dissipation type shed tunnel support structure according to claim 2, wherein the buffers are wavy-wall cylindrical elastoplastic buffers, wherein the wavy-wall cylindrical elastoplastic buffers are formed by pressing thin-walled short tubes of an elastoplastic material with wavy walls.

10. The two-stage energy dissipation type shed tunnel support structure according to claim 2, wherein each layer of the plurality of layers comprises more than two section steel members.

11. The two-stage energy dissipation type shed tunnel support structure according to claim 1, wherein steel plates are fixed at bottoms of the buffers below bottom section steel members of the Dougong joint domain, and bolts penetrate through the steel plates to fix the steel plates to the columns.

12. The two-stage energy dissipation type shed tunnel support structure according to claim 11, wherein the buffers are wavy-wall cylindrical elastoplastic buffers, wherein the wavy-wall cylindrical elastoplastic buffers are formed by pressing thin-walled short tubes of an elastoplastic material with wavy walls.

13. The two-stage energy dissipation type shed tunnel support structure according to claim 11, wherein each layer of the plurality of layers comprises more than two section steel members.

14. The two-stage energy dissipation type shed tunnel support structure according to claim 1, wherein each the U-shaped sliding connecting troughs is provided with slotted holes, and bolts penetrate through the slotted holes and the bolts are fixed in corresponding reserved holes on a side wall of a corresponding section steel member.

15. The two-stage energy dissipation type shed tunnel support structure according to claim 14, wherein the buffers are wavy-wall cylindrical elastoplastic buffers, wherein the wavy-wall cylindrical elastoplastic buffers are formed by pressing thin-walled short tubes of an elastoplastic material with wavy walls.

16. The two-stage energy dissipation type shed tunnel support structure according to claim 14, wherein each layer of the plurality of layers comprises more than two section steel members.

17. The two-stage energy dissipation type shed tunnel support structure according to claim 1, wherein the buffers are wavy-wall cylindrical elastoplastic buffers, wherein the wavy-wall cylindrical elastoplastic buffers are formed by pressing thin-walled short tubes of an elastoplastic material with wavy walls.

18. The two-stage energy dissipation type shed tunnel support structure according to claim 1, wherein each layer of the plurality of layers comprises more than two section steel members.

19. The two-stage energy dissipation type shed tunnel support structure according to claim 1, wherein a side wall of the U-shaped sliding connecting troughs is attached to a side wall of the section steel members, and the side wall of the U-shaped sliding connecting troughs is pre-polished by a shot blasting to form a friction energy dissipation surface.

20. A design method of the two-stage energy dissipation type shed tunnel support structure connected by the principle of Dougong according to claim 1, comprising the following steps:

a. presetting a protection capability $E_{impact}$ of a shed tunnel;

b. calculating an impact energy $E_{structure}$ received by the two-stage energy dissipation type shed tunnel support structure, wherein a calculation formula is expressed as:

$$E_{structure} = \alpha\varphi E_{impact};$$

wherein α is an energy dissipation distribution coefficient of the two-stage energy dissipation type shed tunnel support structure, wherein α is a first empirical value, and α is 0.2-0.4; φ is a safety factor, wherein φ is a second empirical value, and φ is more than 2;

c. estimating an energy dissipation $E_{Dougong}$ of a single Dougong joint domain, wherein a calculation formula is expressed as:

$$E_{Dougong} = \beta E_{structure};$$

wherein β is an energy dissipation coefficient of the single Dougong joint domain;

d. designing n number of joint layers according to construction requirements;

e. designing an energy dissipation buffering capacity $E_S$ of a single wavy-wall cylindrical elastoplastic buffer according to the energy dissipation $E_{Dougong}$ of the single Dougong joint domain and the n number of joint layers, satisfying the formula:

$$4nE_S \geq E_{Dougong};$$

f. selecting wavy-wall cylindrical elastoplastic buffers of corresponding specifications according to a required energy dissipation buffering capacity $E_S$, wherein specification parameters are a material type, a wall thickness, a cylindrical diameter and a cylindrical height, and a wave number;

g. selecting the section steel members of the corresponding specifications according to a flexural bearing capacity, wherein a principle of design is, under rated energy dissipation requirements, only a plastic deformation of a cross section is considered, and the following formula is satisfied:

$$\frac{M}{\gamma W} \geq f$$

wherein M is a maximum bending moment that a member bears, the member only bears a uniaxial bending moment, and a value of a bending moment is obtained by a numerical calculation; W is a net section modulus of an axis corresponding to the bending moment; γ is a section plastic development coefficient, wherein γ is less than or equal to 1.1; f is a design value of a bending strength of a steel;

h. obtaining required bearing capacities of the crossbeam and the columns by the numerical calculation, and designing the crossbeam and the columns of the two-stage energy dissipation type shed tunnel support structure; and i. checking, by the numerical calculation or experiments, whether protection requirements are met.

* * * * *